US006484676B2

(12) United States Patent
Shimizu et al.

(10) Patent No.: US 6,484,676 B2
(45) Date of Patent: Nov. 26, 2002

(54) APPARATUS AND METHOD FOR CONTROLLING VARIABLE VALVE TIMING OF INTERNAL COMBUSTION ENGINE

(75) Inventors: Hirokazu Shimizu, Atsugi (JP); Isamu Iizuka, Atsugi (JP)

(73) Assignee: Unisia Jecs Corporation, Kanagawa_Ken (JP)

( * ) Notice: Subject to any disclaimer, the term of this patent is extended or adjusted under 35 U.S.C. 154(b) by 0 days.

(21) Appl. No.: 09/887,125

(22) Filed: Jun. 25, 2001

(65) Prior Publication Data

US 2002/0000212 A1 Jan. 3, 2002

(30) Foreign Application Priority Data

Jun. 29, 2000 (JP) ..... 2000-197021

(51) Int. Cl.[7] ..... F10L 1/34

(52) U.S. Cl. ..... 123/90.15; 123/90.17; 464/1; 464/2; 464/160

(58) Field of Search ..... 123/90.15, 90.17, 123/90.18, 90.16; 464/1, 2, 160

(56) References Cited

U.S. PATENT DOCUMENTS 5,469,818 A * 11/1995 Yoshioka et al. ..... 123/90.15
5,531,193 A * 7/1996 Nakamura ..... 123/90.15
5,622,144 A * 4/1997 Nakamura ..... 123/90.15
5,626,109 A * 5/1997 Yasumura ..... 123/90.15
5,845,613 A * 12/1998 Yoshikawa ..... 123/90.15
6,109,225 A * 8/2000 Ogita et al. ..... 123/90.15
6,266,957 B1 * 7/2001 Nozawa et al. ..... 60/284
6,283,074 B1 * 9/2001 Takahashi et al. ..... 123/90.15

FOREIGN PATENT DOCUMENTS

JP 2000-8896 1/2000

* cited by examiner

*Primary Examiner*—Thomas Denion
*Assistant Examiner*—Ching Chang
(74) *Attorney, Agent, or Firm*—Sughrue Mion, PLLC

(57) ABSTRACT

The reference valve timing of an intake valve and an exhaust valve is set based on an engine load detected and an engine rotation speed detected. An engine start and an engine idling condition are detected. The valve timing of the intake valve and the exhaust valve is controlled, while maintaining valve overlap amounts to be substantially the same, so that a valve overlap center becomes at an advance side from an exhaust top dead center, with respect to the reference valve timing, at the engine start and in the idling condition during a predetermined period of time after the engine start.

12 Claims, 3 Drawing Sheets

APPARATUS AND METHOD FOR CONTROLLING VARIABLE VALVE TIMING OF INTERNAL COMBUSTION ENGINE

FIELD OF THE INVENTION

The present invention relates to a variable valve timing control technology for variably controlling the opening and closing timing of an intake valve and an exhaust valve of an internal combustion engine, and especially to a technology for reducing hydrocarbon emissions at an engine idling condition immediately after an engine start.

RELATED ART OF THE INVENTION

There are many unburned hydrocarbons in the exhaust due to the low combustion temperature immediately after an engine start. Further, since the exhaust gas temperature is also low, an exhaust gas purification catalytic converter is not activated. Therefore, hydrocarbon emissions are likely to increase. Especially, at the end period of exhaust stroke, unburned hydrocarbons adhered to an inner wall of a cylinder are peeled off to be discharged, which promotes an increase of a hydrocarbon emission amount from the cylinder.

Therefore, in Japanese Unexamined Patent Publication No. 2000-8896, a variable valve mechanism is disposed at an intake valve, wherein, at an engine cold period, the opening time of the intake valve is controlled to be advanced so that overlap amounts of the intake valve and an exhaust valve are increased. Thereby, hydrocarbons with a small molecular weight generated in the vicinity of a top dead center are sucked back to an intake system to increase a hydrocarbon amount remaining in the cylinder to be re-burned at the next stroke, thereby achieving the reduction of the unburned hydrocarbon emissions.

However, at the time immediately after the engine start, if the valve overlap amounts are increased by advancing the opening time of the intake valve as above, at a first cycle more unburned hydrocarbons can be remained as an inner EGR, while there is a possibility that the combustion becomes unstable at a second cycle or thereafter, leading to the deterioration of drivability.

Further, hydrocarbons with a relatively large molecular weight are increased accompanied with this unstable combustion. In order to eliminate these hydrocarbons with a relatively large molecular weight, there is a need to dispose a HC adsorbent using zeolite and the like in an exhaust passage, in addition to a three-way catalytic converter.

SUMMARY OF THE INVENTION

In view of the foregoing conventional problems, the present invention has been achieved and an object of the invention is to reduce hydrocarbon emissions from an engine immediately after an engine start without the deterioration of engine drivability, by optimally controlling the opening and closing timing of an intake valve and an exhaust valve.

In order to achieve the above object, with the present invention, the valve timing of an intake valve and an exhaust valve is controlled as follows.

An engine load and an engine rotation speed are detected, and then the reference valve timing of the intake valve and the exhaust valve is set based on the detected engine load and rotation speed.

An engine start and an engine idling condition are detected. At the engine start time and in the engine idling condition during a predetermined period of time after the engine start, the valve timing of the intake valve and the exhaust valve is controlled, while maintaining the valve overlap amounts to be substantially the same, so that a valve overlap center is positioned at an advance side from an exhaust top dead center with respect to the reference valve timing.

According to this constitution, without an increase of an inner EGR amount (burned gas amount), unburned hydrocarbons included in the inner EGR can be increased and more unburned hydrocarbons can be remained in a cylinder to be re-burned in a next stroke. Accordingly, hydrocarbon emissions can be reduced without damaging the combustion performance.

Further, in the engine idling condition after the above predetermine time has elapsed, the valve timing of the intake valve and the exhaust valve is controlled to a retard side with respect to the reference valve timing, while maintaining the valve overlap amounts to be substantially the same.

According to this constitution, it becomes possible to make the unburned hydrocarbons to remain for a long period in the cylinder, the temperature of which has risen due to the elapse of the predetermined period, so that oxidization of the unburned hydrocarbons after combustion is promoted. As a result, the hydrocarbon emissions from the engine can be reduced effectively.

Further, in a case where the predetermined period of time is set based on the detected engine temperature, this predetermined period of time may be set based on an elapsed time after a measured engine start or a cycle number after the measured engine start.

Moreover, switching from an advance control to a retard control with respect to the above reference valve timing is carried out gradually.

According to this constitution, a change of the valve timing can be made without damaging the engine drivability.

The other objects and features of this invention will become understood from the following description with accompanying drawings.

EMBODIMENT

An embodiment according to the invention will be explained with reference to accompanying drawings.

Figure 1:
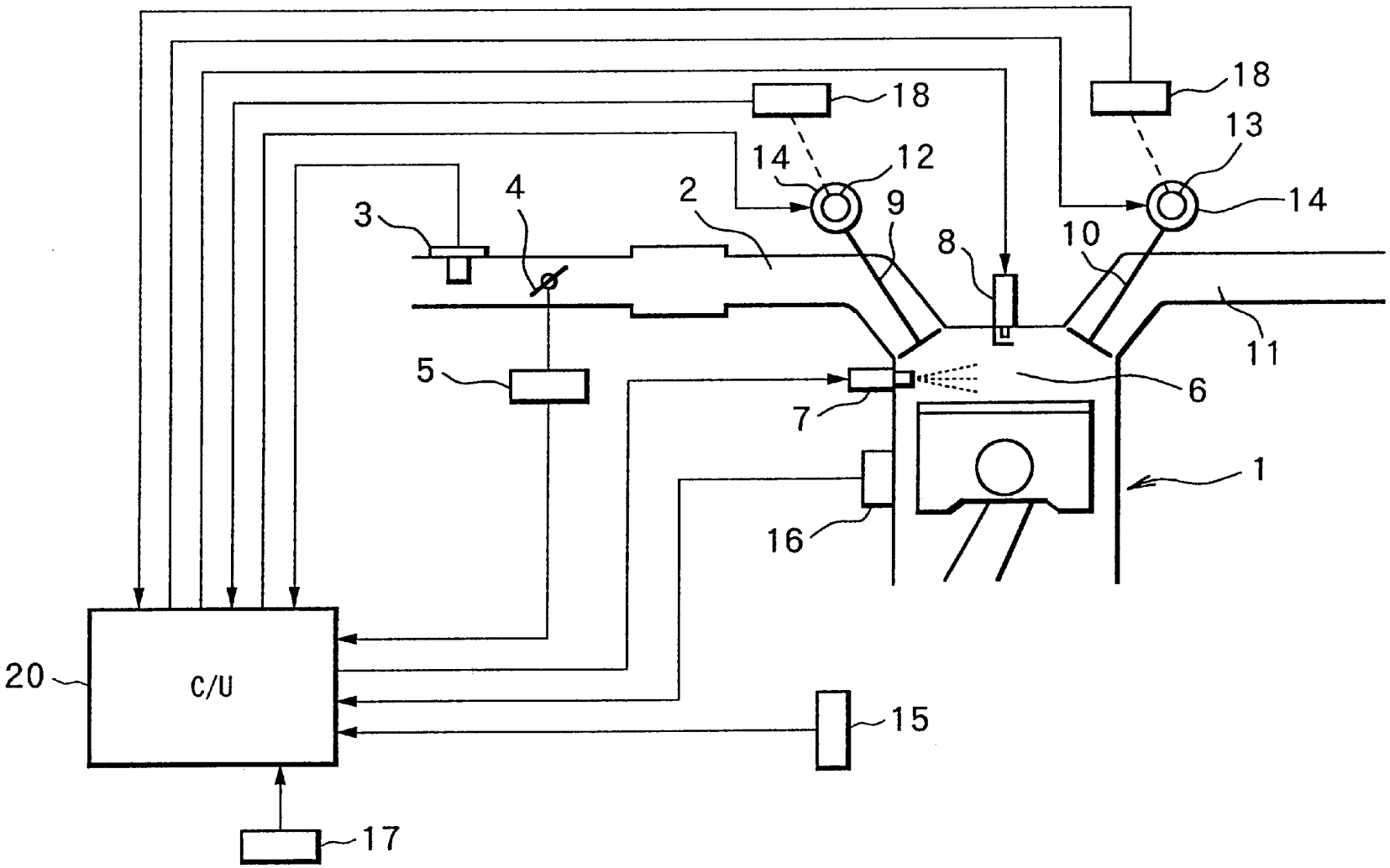
FIG. 1 is a diagram showing a system structure of an embodiment according to the invention.

In FIG. 1 showing a system structure of the embodiment, an air flow meter 3 is disposed in an intake passage 2 of an engine 1 to detect an intake air flow quantity Q, which is controlled by a throttle valve 4. The throttle valve 4 is equipped with a throttle sensor 5 for detecting the opening degree of the throttle valve 4. The throttle sensor 5 incorporates therein an idle switch, which is turned ON at an engine idling condition where the opening degree of the throttle valve is equal to or less than a predetermined opening degree.

A fuel injection valve 7 for injecting fuel into a combustion chamber 6, and an ignition plug 8 for performing spark ignition in the combustion chamber 6 are disposed in each cylinder of the engine 1. The fuel is injected from the fuel injection valve 7 to air sucked through an intake valve 9 to form the air-fuel mixture, and the air-fuel mixture is compressed in the combustion chamber 6 to be ignited by spark ignition by the ignition plug 8.

The exhaust in the engine 1 is discharged from the combustion chamber 6 to an exhaust passage 11 through an exhaust valve 10 and is released in the atmosphere via an exhaust gas purification catalytic converter and a muffler (not shown).

The intake valve 9 and the exhaust valve 10 are driven to open/close by cams disposed on an intake camshaft 12 and an exhaust camshaft 13. At each of the intake camshaft 12 and the exhaust camshaft 13, a variable valve timing mechanism 14 is disposed, which successively advances and retards the valve opening and closing timing while maintaining the valve opening and closing degree to be constant, by changing a rotation phase of the camshaft relative to a crankshaft.

A control unit 20 incorporates therein a microcomputer, to control a fuel injection quantity and the fuel injection timing of the fuel injection valve 7, and the injection timing of the ignition plug 8 based on various detection signals to be input.

The various detection signals to be input, are an intake air flow quantity signal Q from the air flow meter 3, a crank angle signal from a crank angle sensor 15, an engine cooling water temperature signal Tw from a water temperature sensor 16, an ON/OFF signal from a start switch 17, an ON/OFF signal from the idle switch and the like. An engine rotation speed is calculated based on the crank angle signal.

The control unit 20, based on a detection signal from the crank angle sensor 15, and detection signals from cam sensors 18 on the intake and the exhaust sides, detects the rotation phase of the intake camshaft relative to the crankshaft and the rotation phase of the exhaust camshaft relative to the crank shaft, to detect the opening and closing timing of the intake and the exhaust valves. Further, the control unit 20 determines a target advance value or a target retard value of the rotation phase of each of the intake valve and the exhaust valve, based on information of the engine load, the engine rotation speed Ne, the cooling water temperature Tw and the like, to control the opening and closing timing of the intake valve and the exhaust valve.

Figure 2:
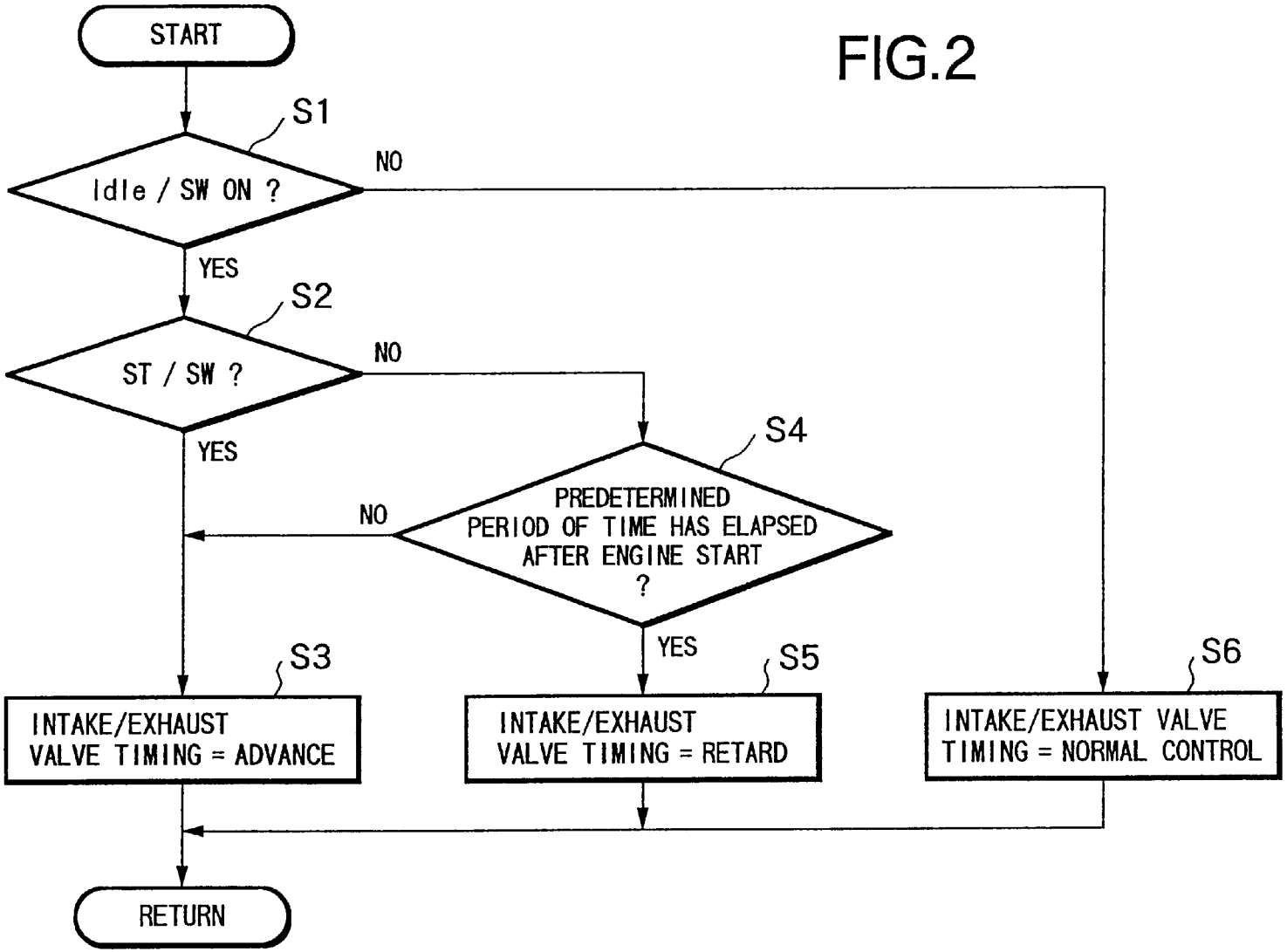
FIG. 2 is a flowchart showing a variable valve timing control of the embodiment according to the invention.

Next, a valve timing control immediately after the engine start will be explained based on FIG. 2.

At Step 1, it is judged whether the idle switch is ON or OFF. When the idle switch is ON, the procedure goes to Step 2.

At Step 2, it is judged whether the start switch is ON or OFF. At the engine start where the start switch is ON, the procedure goes to Step 3.

Figure 3:
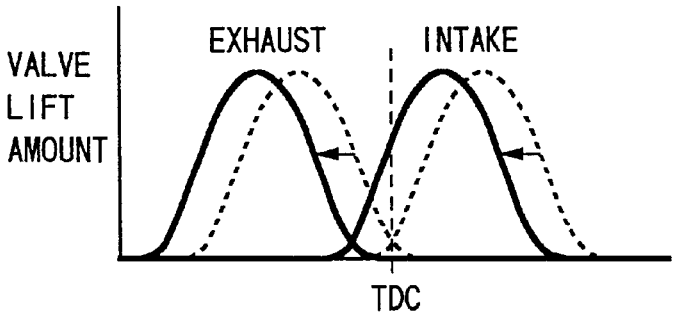
FIG. 3 is a graph showing the opening and closing timing of an intake valve and an exhaust valve at an engine start time in the embodiment according to the invention.

At Step 3, as shown in FIG. 3, the valve timing is advanced by a predetermined angle (for example, about 15 degrees), while maintaining valve overlap amounts to be substantially the same, with respect to the reference valve timing (dotted line) of the intake and exhaust valves set based on the engine load and engine rotation speed, so that a valve overlap center is controlled to be positioned at an advance side from an exhaust top dead center.

When it is judged at Step 2 that the start switch is OFF, the procedure goes to Step 4.

At Step 4, it is judged whether or not a predetermined period of time has elapsed from the engine start. This predetermined period of time is for grasping a temperature state of the engine, based on which it is judged whether or not the engine temperature has risen up to a predetermined temperature where an influence of unburned hydrocarbons adhered to a cylinder inner wall on the exhaust becomes sufficiently small. Accordingly, the predetermined period of time may be set based on an elapsed time from the engine start the relationship of which with the engine temperature is known in advance or the number of cycles from the engine start, or may be set by directly detecting the cooling water temperature Tw of the engine.

If the predetermined period of time has not elapsed, since the engine temperature is low and the influence of fuel adhered to the cylinder inner wall is large, the procedure goes to Step 3 in order to reduce hydrocarbon emissions at the end period of exhaust stroke, where as described before, the valve timing of the intake valve and the exhaust valve is advanced by a predetermined degree (for example, about 15 degrees) with respect to the reference valve timing. This is the valve timing at the idling condition during the predetermined period of time after the engine start.

By controlling the valve timing in such a way, at the engine start and in the idling condition during the predetermined period of time after the engine start, the hydrocarbon emissions will be reduced as follows.

Figure 4:
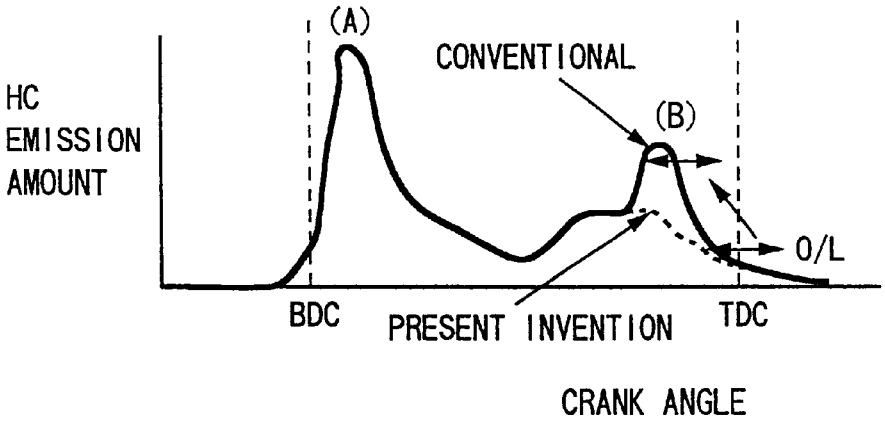
FIG. 4 is a graph showing a hydrocarbon emission amount at an exhaust stroke.

In general, a hydrocarbon emission amount, as shown in FIG. 4, has two peak values, one in the initial period of exhaust stroke (part A in FIG. 4) and the other in the end period of exhaust stroke (part B in FIG. 4). The peak value in the initial period of exhaust stroke occurs since the unburned hydrocarbons remaining at the periphery of the exhaust valve are discharged, and the peak value in the end period of the exhaust stroke occurs since the unburned hydrocarbons adhered to the cylinder inner wall are peeled off to be discharged.

Since the engine temperature is low immediately after the engine start, an amount of fuel (unburned hydrocarbons) adhered to the cylinder inner wall are large. Therefore, it is required to restrain the emissions (part B in FIG. 4) of the unburned hydrocarbons peeled off to be discharged at the end period of exhaust stroke.

Therefore, as shown in FIG. 4, the valve overlap center (to be referred as OIL in FIG. 4) is advanced by a predetermined degree while maintaining the valve overlap amounts to be substantially the same.

In this way, without an increase of an inner EGR amount (remaining gas amount), the unburned hydrocarbons included in the inner EGR can be increased, to be re-burned at the next stroke, thereby enabling the reduction of the emissions of the unburned hydrocarbons.

In detail, conventionally, only the exhaust valve is driven to open at an advance side from the exhaust top dead center where a piston rising speed is large. As a result, a strong exhaust flow is formed toward an exhaust port, and thus the unburned hydrocarbons peeled off from the cylinder wall are discharged strongly with the exhaust.

Accordingly, the unburned hydrocarbon amount to be re-sucked into the cylinder during the succeeding valve overlap period is small, and as a result, the hydrocarbon emission amount is increased (actual line in FIG. 4).

On the contrary, according to the present invention, a valve overlap is set at the advance side from the exhaust top dead center where a piston rising speed is large, and the intake valve as well as the exhaust valve are driven to open. Therefore, the combustion gas flows out distributively to the exhaust port and the intake port.

As a result, an exhaust flow speed becomes slower, and the amount of unburned hydrocarbons peeled off from the cylinder wall is reduced. Further, a flow rate into the exhaust port is reduced, while the unburned hydrocarbons flown out into the intake port is re-sucked into the cylinder. Therefore, the hydrocarbon emission amount can be reduced remarkably (dotted line in FIG. 4).

Note, since the valve overlap amounts are maintained to be substantially the same, an increase of the inner EGR amount (burned gas) can be prevented, thereby ensuring a stable combustion characteristic and also drivability.

Returning to Step 4, when the predetermined period of time has elapsed from the engine start, the procedure goes to Step 5.

Figure 5:
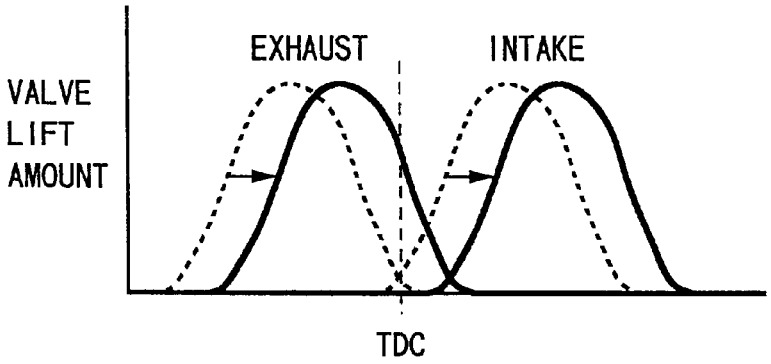
FIG. 5 is a graph showing the opening and closing timing of the intake valve and the exhaust valve after a predetermined time has elapsed from the engine start in the embodiment according to the invention.

At Step 5, as shown in FIG. 5, the valve timing is retarded by a predetermined degree from the reference valve timing (dotted line) while maintaining the valve overlap amounts to be substantially the same (the valve overlap center is retarded by the predetermined degree).

Then, since the engine temperature rises in the idling condition after the predetermined period of time has elapsed from the engine start, the hydrocarbon emissions will be reduced as follows.

The unburned hydrocarbons in the engine are oxidized even after burned (flame propagation) by heat generated at combustion. Since the oxidization of the unburned hydrocarbons after burned depends on the temperature and time, the opening time of exhaust valve is delayed by retarding the reference valve timing by a predetermined degree, so that the unburned hydrocarbons are made to remain longer in the cylinder the temperature of which has risen due to the elapse of the predetermined period of time, to promote the oxidization of the unburned hydrocarbons, thereby reducing the hydrocarbon emissions.

Preferably, a change in the valve timing to be performed after the predetermined period of time has elapsed from the engine start is carried out gradually so as to avoid an influence on the engine drivability.

Further, at Step 1, when the idle switch is OFF, the procedure goes to Step 6, where a normal valve timing control for setting a valve timing based on the engine load and the rotation speed is performed.

By controlling the valve timing as described above, at the time of engine start and of immediately after the engine start, the hydrocarbon emissions can be reduced effectively without any influence on the engine drivability. Further, there is no need to newly prepare another adsorbent to absorb hydrocarbons with a large molecular weight.

The entire contents of Japanese Patent Application No. 2000-197021 filed Jun. 29, 2000 are incorporated herein by reference.

What is claimed:

1. An apparatus for controlling the variable valve timing of an internal combustion comprising:

an engine equipped with an intake valve and an exhaust valve, valve timing of which is variably controlled;

a start detection unit for detecting an engine start;

an elapsed period detection unit for detecting an elapsed period after said engine start;

an idling condition detection unit for detecting an engine idling condition;

an operation condition detection unit for detecting an engine operation condition including an engine load and an engine rotation speed;

a reference valve timing setting unit for setting the reference valve timing of said intake valve and said exhaust valve based on said detected operation condition; and a valve timing setting unit for engine start and idling condition, for setting a valve overlap center at an advance side from an exhaust top dead center, while maintaining valve overlap amounts to be substantially the same, with respect to said reference valve timing, at said engine start time and in said idling condition during a predetermined period of time after said engine start.

2. An apparatus for controlling the variable valve timing of an internal combustion according to claim 1, wherein said valve timing setting unit for engine start and idling condition sets said valve overlap center at a retard side, while maintaining said valve overlap amounts to be substantially the same, with respect to said reference valve timing, in the idling condition after an elapse of said predetermined period of time.

3. An apparatus for controlling the variable valve timing of an internal combustion according to claim 1, wherein said elapsed period detection unit detects the engine temperature to set said predetermined period of time based on said detected engine temperature.

4. An apparatus for controlling the variable valve timing of an internal combustion according to claim 1, wherein said elapsed period detection unit measures an elapsed time from the engine start to set said predetermined period of time based on said measured elapsed time.

5. An apparatus for controlling the variable valve timing of an internal combustion according to claim 1, wherein said elapsed period detection unit measures the number of cycles from the engine start to set said predetermined period of time based on said measured number of cycles.

6. An apparatus for controlling the variable valve timing of an internal combustion according to claim 1, wherein said valve timing setting unit for engine start and idling condition gradually sets said valve overlap center to the retard side when switching said valve overlap center from the advance side to the retard side with respect to said reference valve timing.

7. A method for controlling the variable valve timing of an internal combustion engine, wherein the valve timing of an intake valve and an exhaust valve at an engine start and in an idling condition during a predetermined period of time after said engine start is advanced, while maintaining valve overlap amounts to be substantially the same, with respect to a reference valve timing set based on an engine load and an engine rotation speed so that a valve overlap center is controlled at an advance side from an exhaust top dead center.

8. A method for controlling the variable valve timing of an internal combustion engine according to claim 7, wherein said valve timing of the intake valve and the exhaust valve in the idling condition after an elapse of the predetermined period of time is controlled at a retard side, while maintaining the valve overlap amounts to be substantially the same, with respect to said reference valve timing.

9. A method for controlling the variable valve timing of an internal combustion engine according to claim 7, wherein said predetermined period of time is set based on the engine temperature.

10. A method for controlling the variable valve timing of an internal combustion engine according to claim 7, wherein said predetermined period of time is set based on an elapsed time from the engine start.

11. A method for controlling the variable valve timing of an internal combustion engine according to claim 7, wherein said predetermined period of time is set based on the number of cycles from the engine start.

12. A method for controlling the variable valve timing of an internal combustion engine according to claim 7, wherein said valve overlap center is switched gradually from the advance side to the retard side with respect to said reference valve timing.

* * * * *